US008034730B2

(12) United States Patent
Westerkamp et al.

(10) Patent No.: US 8,034,730 B2
(45) **Date of Patent: *Oct. 11, 2011**

(54) COMPOSITE PRESS FABRIC

(75) Inventors: Arved Westerkamp, Dettingen/Erms (DE); Robert Crook, Wilson, NC (US); Robert Eberhardt, Ellwangen (DE)

(73) Assignee: Voith Patent GmbH, Heidenheim (DE)

( * ) Notice: Subject to any disclaimer, the term of this patent is extended or adjusted under 35 U.S.C. 154(b) by 177 days.

This patent is subject to a terminal disclaimer.

(21) Appl. No.: 12/339,134

(22) Filed: Dec. 19, 2008

(65) Prior Publication Data

US 2009/0186546 A1 Jul. 23, 2009

Related U.S. Application Data

(60) Provisional application No. 61/015,843, filed on Dec. 21, 2007.

(51) Int. Cl.
*B32B 5/26* (2006.01)
*B32B 5/06* (2006.01)

(52) U.S. Cl. ..... 442/381; 442/255; 442/268; 442/270; 442/271; 442/388; 442/417

(58) Field of Classification Search ..... 442/255, 442/268, 270, 271, 381, 388, 417
See application file for complete search history.

(56) References Cited

U.S. PATENT DOCUMENTS

| | | | | |
|---|---|---|---|---|
| 4,781,967 | A * | 11/1988 | Legge et al. | 428/109 |
| 5,232,768 | A * | 8/1993 | Eklund et al. | 442/225 |
| 5,549,967 | A | 8/1996 | Gstrein | |
| 6,712,940 | B2 * | 3/2004 | Crook | 162/306 |
| 2005/0181694 | A1 * | 8/2005 | Crook et al. | 442/270 |
| 2006/0016545 | A1 * | 1/2006 | Hansen | 156/148 |
| 2006/0130992 | A1 * | 6/2006 | Ouchi et al. | 162/358.1 |
| 2007/0003760 | A1 * | 1/2007 | Crook et al. | 428/375 |

FOREIGN PATENT DOCUMENTS

| | | | |
|---|---|---|---|
| EP | 1127976 | A2 | 8/2001 |
| WO | 03076046 | A2 | 8/2003 |
| WO | 2004085727 | A2 | 10/2004 |

* cited by examiner

*Primary Examiner* — Norca L Torres Velazquez
(74) *Attorney, Agent, or Firm* — Taylor IP, P.C.

(57) ABSTRACT

A press fabric for a machine for the production of web material, especially paper or cardboard, including a carrying structure and a plurality of layers on one web material contact side of the carrying structure, whereby polymeric material is contained in at least one of the layers of fibrous material.

16 Claims, 1 Drawing Sheet

COMPOSITE PRESS FABRIC

CROSS REFERENCE TO RELATED APPLICATIONS

This is a non-provisional application based upon U.S. provisional patent application Ser. No. 61/015,843 entitled "COMPOSITE PRESS FABRIC II", filed Dec. 21, 2007, which is incorporated herein by reference.

BACKGROUND OF THE INVENTION

1. Field of the Invention

The present invention relates to a press fabric for a machine for the production of web material, specifically paper or cardboard, and to a method to produce said press fabric.

2. Description of the Related Art

A press fabric of this type generally includes a carrying structure, for example, in the embodiment of a woven or randomly laid structure, or a so-called spiral-link structure. On one side of this carrying structure in contact with the web material, fibrous material, which may be in the form of several layers of fibrous material, is provided and is generally tightly bonded with the carrying structure by means of needling. Press fabrics of this type, which may be provided in an endless configuration, are utilized first and foremost in so-called press sections in paper machines where the press fabrics are moved through press nips together with the web material which is being produced. During this process, liquid is squeezed from the web material and absorbed by, or removed through the press fabric. In order to improve the liquid absorption capacity of the press fabric, a layer, which has a comparatively high hollow space volume in which the water that is pressed out of the web material can be absorbed, is provided in a known method between the carrying structure and one fibrous layer which represents a web material contact surface. These layers may also be in the form of a woven fabric. This, of course, has the disadvantage that due to the location of a fabric layer relatively near the web material contact surface, the fabric structure marks the web material which is to be produced. A known alternative is the introduction of polymeric material membranes or membranes of similar types of material which are designed essentially with a plain surface and a multitude of openings. These membranes are, however, expensive to produce.

A press fabric for a machine for the production of web material, especially paper or cardboard, as well as a method for the manufacture of a press fabric of this type with which the volume for liquid absorption can be increased without the risk of marking the web material that is to be produced.

What is needed in the art is a press fabric for a machine for the production of web material, especially paper or cardboard, as well as a method for the manufacture of a press fabric of this type with which the volume for liquid absorption can be increased without the risk of marking the web material that is to be produced.

SUMMARY OF THE INVENTION

The present invention provides a press fabric, especially a press felt for a machine for the production of web material, especially paper or cardboard, including a carrying structure, a layer of fibrous material providing a web material contact surface and at least one layer of fibrous material which contains polymeric material that forms a film which at least partially coats at least a part of the fibers in this layer and which is located between the carrying structure and the layer providing the web material contact surface.

The press fabric of the present invention includes a layer which is located between the layer which provides the web material contact surface and the carrying structure. In other words, a layer which is located deeper inside the body of the press fabric and which is intended to provide a large volume for the absorption of liquid, and which is composed of an essentially fibrous structure, for example felt or formed fabric, and is interspersed with a polymeric material which at least partially coats fibers of this layer with a film. Based on its pore structure, this structure provides sufficient volume for the absorption of liquid, and avoids a uniform pattern which would mark through the web material which is to be produced. The polymeric material which partially covers the fibers in the fibrous layer in the form of a film is firmly bonded with the fibers.

One or more additional layers of fibrous material may be also be arranged between the fibrous layer which provides the web material contact surface, and the carrying structure in addition to the layer containing the polymeric material. This layer or these layers may also contain polymeric material. It is also feasible that this layer or these layers do not contain any polymeric material. If there are several layers, then one or several layers may contain polymeric material, the same as one or several layers may not contain any polymeric material. This polymeric material may be arranged on the entire thickness of the layer of fibrous material containing same. At least 70% of the fibers in the fibrous layer are coated to 70% with the film. In addition, all fibers in the fibrous layer may be coated completely with the film of polymeric material.

In order to provide an especially efficient water retention volume, it is meaningful if the layer of fibrous material containing the polymeric material contains fibers in the range of 44 dtex or more. For example, the layer of fibrous material which contains the film-forming polymeric material may contain fibers in the range of 44 to 200 dtex. In one embodiment, the fibrous layer containing the polymeric material is composed of fibers in the range of 44 to 200 dtex. The fibrous layer containing the polymeric material may also be composed of fibers in the range of 44 to 140 dtex.

Depending on the respective process control during the manufacture of the present invention some of the polymeric material which is integrated into the at least one layer of fibrous material which is located between the carrying structure and the fibrous layer providing the web material contact surface, may get into the layer of fibrous material providing the web material contact surface, for example, during the needling process.

One embodiment of the present invention provides that less polymeric material is contained in the layer of fibrous material providing the web material contact surface than in the at least one fibrous layer which is located between the web material contact surface layer and the carrying structure.

Preferably there is essentially no polymeric material adhering to the fibers in the fibrous layer which provides the web material contact surface. Essentially "no polymeric material" is meant to mean in this instance, that less than 10%, especially less than 5% of the weight of this layer is determined by the polymeric material. The layers of fibrous material may be bonded with the carrying structure through needling. The polymeric material may be furnished into the at least one fibrous layer in form of an aqueous dispersion from which the liquid was subsequently removed.

One embodiment of the present invention provides an additional polymeric material contained in the fibrous layer providing the web material contact surface brought into this layer from the direction of the web material contact surface, which may be in the form of particles subsequently melted and, after solidifying with this layer, forms a fluid-permeable composite structure. The additional polymeric material may be furnished in form of an aqueous particle dispersion of the additional polymeric material. The liquid is then subsequently removed from the dispersion and the additional polymeric material is then melted and again solidified. Melting may occur by means of hot-calendering, resulting in additional smoothing of the web material contact surface. A fluid-permeable composite structure is thereby formed from the fibers of the fibrous layer and the additional polymeric material in that the additional polymeric material only partially fills and/or bridges hollow spaces between the fibers of the fibrous layer. In this instance the additional polymeric material, in particular, forms a permeable polymeric continuous formation or a single component permeable polymeric layer. A single-component polymeric layer is understood to be a polymeric layer which is formed from one single continuous component.

In order to provide permeability, openings extend through the polymeric layer. The openings in the polymeric layer are formed in that the polymeric material which forms the polymeric layer fills and/or bridges the hollow spaces between the fibers of the fibrous layer only partially. To verify that the permeable polymeric layer is indeed a single component, the fibrous material—if it is for example polyamide—can be dissolved, for example, with formic acid. The polymeric material which forms the film may have a higher melting temperature than the additional polymeric material which fills and/or bridges hollow spaces which are formed between the fibers of the fibrous layer providing the web material contact surface.

The additional polymeric material, when viewed from the web material contact surface, may extend to a maximum depth of 500 μm, 300 μm, or 200 μm into the fibrous layer providing said contact surface. This creates a press fabric which has a high "internal" water retention volume as well as a smooth web material contact surface with low marking tendency.

Provision can be made such that the polymeric material with regard to the fibrous layer containing same, accounts for at least 10 weight %. In order to be able to even better ensure the desired restoring characteristic of this press fabric, especially in the layer containing the polymeric material it is suggested that the polymeric material has a hardness in the range of 50 to 97 Shore A. The polymeric material may be an elastomer, especially a polyurethane.

The structure formed by the at least one layer of fibrous material with the film which at least partially coats the fibers of this layer may be elastically compressible, so that the press fabric returns very quickly into its original form after passing through a press nip, thereby largely eliminating the risk of remoistening. The press fabric may be fluid permeable.

In order to increase the elasticity of the inventive press fabric further it is useful if fibers of the at least one layer of fibrous material are interconnected with each other at crossing points through the polymeric material. In addition, it can be useful for increasing the elasticity of the press fabric if fiber bundle forming segments of fibers in the at least one layer of fibrous material are interconnected with each other through the polymeric material.

The need for a press fabric with increased liquid absorption capacity and decreased risk of marking the web material being produced is further solved by a method for the manufacture of a press fabric for a machine for the production of web material, especially according to present invention, including the measures:

a) Provision of a carrying structure and a plurality of layers of fibrous material,
b) Adding of polymeric material into at least one layer of fibrous material
c) Locating at least one layer of fibrous material containing the polymeric material between the carrying structure and the layer of fibrous material which provides a web material contact surface;
d) Causing the polymeric material which is added into the layer of fibrous material to create a film which at least partially coats at least part of the fibers in this layer,
e) Solid bonding of the layers of fibrous material with the carrying structure.

On the one hand, the method of the present invention may be controlled so that measure d) is implemented prior to measure e). This means that after the polymeric material is added into at least one layer of fibrous material, the polymeric material added into this layer of fibrous material is caused to envelope fibers of this layer at least partially before the layers of fibrous material and the carrying structure are firmly bonded with each other.

Alternatively, it is feasible that measure e) is implemented prior to measure d). This means that after the polymeric material is added into at least one layer of fibrous material the layers of fibrous material and the carrying structure are first bonded firmly with each other before the polymeric material added into at least one of the layers of fibrous material is caused to envelope fibers of this layer at least partially. In addition, it is feasible that the polymeric material is added into at least one layer of fibrous material before the layer is located above the carrying structure and below the layer of fibrous material which provides the web material contact surface. Alternatively, it is feasible to position at least one layer of fibrous material on the carrying structure, followed by adding the polymeric material into layer and subsequently followed by positioning the layer of fibrous material providing the web material contact surface above the fibrous layer with polymeric material. Preferably, no polymeric material is essentially contained in the layer of fibrous material which provides the web material contact surface.

In order to increase the elasticity of the press fabric, one embodiment of the method of the present invention provides that after and/or during the implementation of measure d) the layer of fibrous material containing the furnished polymeric material is compressed by means of heat reaction. In addition, one could, for example, proceed so that measure b) includes the provision of polymeric material in at least one layer of fibrous material by applying a preferably aqueous dispersion of particle shaped polymeric material onto this layer of fibrous material. Measure d) may include the removal of liquid, especially water from the aqueous dispersion of particle shaped polymeric material. This causes the polymeric material to coat at least part of the fibers in the at least one layer of fibrous material with a film. Measure e) may comprise needling of the layers of fibrous material with the carrying structure.

That layer of fibrous material which contains the polymeric material which coats at least part of the fibers of the layer at least partially by forming a film, may include fibers in the range of 44 dtex or greater. For example, at least one layer may include fibers in the range of 44 to 200 dtex. Alternatively, the at least one layer may include fibers in the range of 44 to 140 dtex. Fibers of this type ensure that basically a comparatively coarse structure of this layer is provided and, therefore, the hollow space component in the volume compared to layers of fibrous material consisting of fibers that have a lower dtex value is large, thereby providing an accordingly high volume for the absorption of liquid. It may be provided that at least one layer of fibrous material containing the particle-shaped polymeric material is coarser than the layer of fibrous material providing the web material contact surface. In this way it is ensured that a very fine structure is available on the web material contact surface, thereby also practically eliminating the danger that individual fibers in the fibrous layer mark the web material which is to be produced.

The carrying structure may be in the embodiment of a woven or a randomly laid structure. Also, an embodiment with a so-called spiral-link structure is feasible, as well as any other structure that ensures that the forces occurring in the forward movement of a press fabric of this type can be absorbed in this carrying structure. One or all layers of fibrous material may be in the form of a non-woven layer.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

Figure 1:
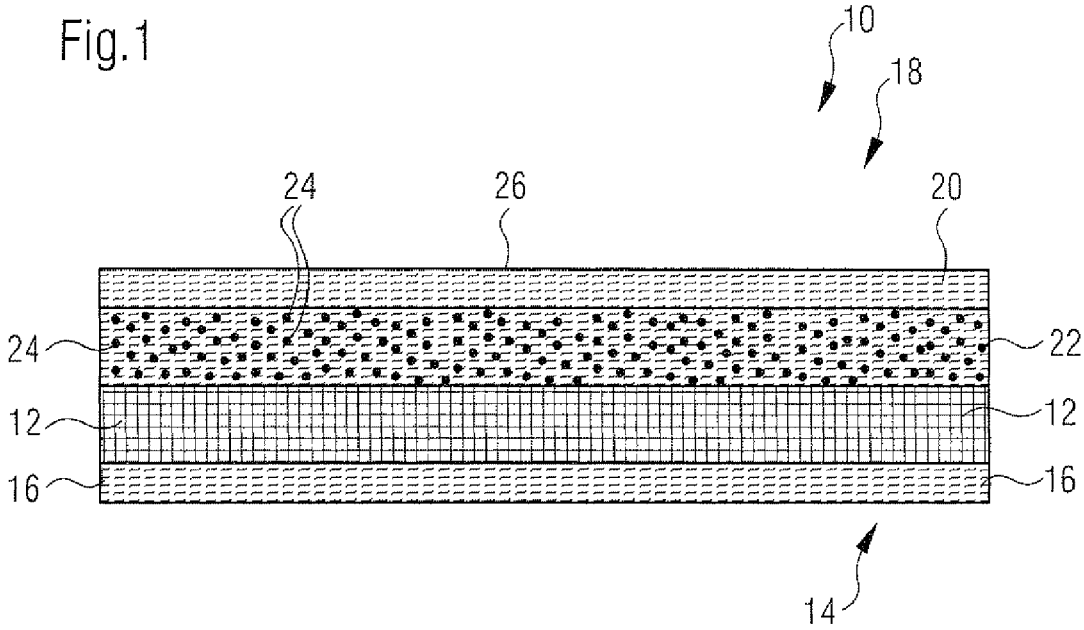
FIG. 1 shows a schematic sectional of an inventively composed press fabric.

Referring now to the drawings, and more particularly to FIG. 1, there is shown a press fabric 10, which may for be utilized in a press section of a paper machine including carrying structure 12 which represents the structure that absorbs the fundamental forces and which may be in the embodiment of a woven or randomly laid structure, or a spiral-link structure. Fibrous material layer 16 is bonded with carrying structure 12 on machine contact side 14. On one side 18 of carrying structure 12 facing web material contact surface 26, two fibrous material layers 20 and 22 are bonded with carrying structure 12. The bonding of fibrous material layers 16, 18 and 20 with carrying structure 12 may occur through needling, so that individual fibers of non-woven or felt layers 16, 18 and 20 may be drawn into the next layer or carrying structure, thereby resulting in a stable bond.

Polymeric material 24 is contained in fibrous material layer 22 located between carrying structure 12 and fibrous layer 20 which forms a film which at least partially coats the fibers in layer 22. The polymeric material is especially an elastomer polymeric material, such as polyurethane or similar material. Fibrous layer 20, which also provides web material contact surface 26, contains essentially no such polymeric material.

Press fabric 10 illustrated in FIG. 1 can be manufactured so that in the first instance carrying structure 12 is produced in endless configuration and stretched across two rolls. Then, in the first instance, layer 22 is applied after polymeric material 22 has been added into said layer—for example in that it is wound spirally over the side of the carrying structure that is open toward the outside, until it is completely covered.

Furnishing of polymeric material 24 into fibrous material layer 22 may consist of applying a preferably aqueous dispersion of particle shaped polymeric material 24 onto layer 22. Following this, layer 20 is applied in a corresponding manner. Layer 16 may already have been provided to carrying structure 12 or may also have been left off.

After carrying structure 12 has been bonded by means of needling, particularly with layers 20 and 22 according to the arrangement shown in FIG. 1, polymeric material 24, which is furnished into fibrous material layer 22, is caused to envelope the fibers in layer 22 at least partially by forming a polymeric film. The cause in this instance may comprise the removal of liquid, especially water from the aqueous dispersion of particle shaped polymeric material 24. Simultaneously with or subsequent to this process step, fibrous material layer 22 can be compressed with added polymeric material 24 by means of heat reaction. This compacts the structure.

Through the partial enveloping of the fibers with polymeric material 24, a comparatively rigid, but based on the elasticity of the polymeric material, but nevertheless elastically workable structure is achieved which is formed by fibrous material layer 22 with polymeric material 24 contained therein. After passing through press nips this structure returns very quickly to its fundamental form, thereby providing sufficient volume to be able to absorb the liquid which is pressed through layer 22 and subsequently release it to the backside, in other words, to machine contact side 14.

Figure 2:
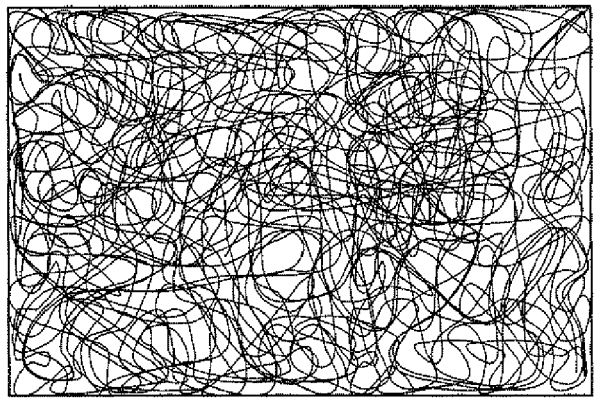
FIG. 2 shows an electron-microscopical micrographic of a layer of fibrous material of this type, and polymeric material contained therein.

In order to achieve the desired distribution of polymeric material 24 in the volume range of fibrous material layer 22 with the previously described method for the production of press fabric 10—in other words, the more or less uniform permeation with polymeric material 24 as shown in FIG. 1—preferably aqueous dispersion of polymeric particles 24 could be applied onto layer 22, as already described. The volume amount should be calculated so that polymeric material 24 is at least 10 weight percent relative to layer 22 of fibrous material. The weight component may for example be at 50 to 600 g/m$^2$. Utilized polymeric material 24, for example, polyurethane can have a hardness in the range of 55 to 100 Shore A. In addition it may be provided that fibrous material layer 22 is composed of fibers in the range of 44 to 200 dtex. This ensures layer 22 is sufficiently coarse and, therefore, has a very large hollow space content, in order to obtain the desired hollow space for the absorption of liquid (see FIG. 2), even after the addition of polymeric material 24. Fibrous material layer 20, which provides web material contact surface 26, has a finer configuration. For example, it is composed of fibers having a dtex value of less than 40 with a lesser hollow space content and, therefore, with a lower porosity than layer 22.

It must be pointed out that various combinations are possible with the previously described press fabric without having to deviate from the principles of the current invention. For example, more than the two illustrated layers of fibrous material may be provided on the web material contact side of carrying structure 12 whereby, however, in a plurality of embodiments that layer or those layers of fibrous material which are to contain the polymeric material do not provide the web material contact side. In other words, at least one additional layer of fibrous material is located on top of these.

When providing several layers of fibrous material with polymeric material contained therein, the polymeric content or the utilized polymeric material can, of course, differ in order to achieve a stepped structuring in which, for example, the hollow space portion, or in other words, the porosity of the individual layers increases in the direction of the carrying structure.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A press fabric for a machine for the production of a fibrous web material, the press fabric comprising:

a carrying structure;

a first layer of fibrous material having a web material contact surface; and at least one second layer of fibrous material being located between said carrying structure and said first layer of fibrous material, said at least one second layer of fibrous material having fibers and including a polymeric material forming a film at least partially coating at least some of said fibers, at least 70% of said fibers being coated to 70% with said film of said polymeric material and said polymeric material being an aqueous dispersion of particle-shaped polymeric material applied onto said at least one second layer of fibrous material, the liquid of said aqueous dispersion having subsequently been removed to form said film, wherein said fibers of said at least one second layer are bonded with each other at crossing points through said polymeric material.

2. The press fabric of claim 1, wherein said at least one second layer includes fibers in the range of 44 dtex or higher.

3. The press fabric of claim 2, wherein said at least one second layer includes fibers in the range of 44 to 200 dtex.

4. The press fabric of claim 3, wherein said at least one second layer includes fibers in the range of 44 to 140 dtex.

5. The press fabric of claim 1, wherein said fibers of said first layer of fibrous material has fibers and substantially no polymeric material adhering to said fibers.

6. The press fabric of claim 1, further comprising additional polymeric material in said first layer, said additional polymeric material being added in the form of particles from the direction of the material contact surface, wherein said additional polymeric material is subsequently melted to form a fluid permeable composite structure.

7. The press fabric of claim 6, wherein said polymeric material extends to a depth of 500 μm when viewed from the web material contact surface.

8. The press fabric of claim 7, wherein said polymeric material extends to depth of 300 μm when viewed from the web material contact surface.

9. The press fabric of claim 8, wherein said polymeric material extends to a depth of 200 μm when viewed from the web material contact surface.

10. The press fabric of claim 1, wherein said polymeric material accounts for at least 10 weight % of said at least one of second layer.

11. The press fabric of claim 1, wherein said polymeric material has a hardness in the range of 50 to 97 Shore A.

12. The press fabric of claim 1, wherein said polymeric material is an elastomer.

13. The press fabric of claim 12, wherein said polymeric material is a polyurethane.

14. The press fabric of claim 1, further comprising fiber bundle forming segments of said fibers of said at least one second layer, said fiber bundle forming segments being interconnected with each other through said polymeric material.

15. The press fabric of claim 1, wherein the structure of said at least one second layer is elastically compressible.

16. The press fabric of claim 1, wherein said carrying structure is bonded to said first layer and said at least one second layer by needling.

* * * * *